US006653943B2

(12) United States Patent
Lamb et al.

(10) Patent No.: US 6,653,943 B2
(45) Date of Patent: Nov. 25, 2003

(54) SUSPENSION ROPE WEAR DETECTOR

(75) Inventors: Miles P. Lamb, Chester, NJ (US); Karl B. Orndorff, Gettysburg, PA (US)

(73) Assignee: Inventio AG, Hergiswil (CH)

( * ) Notice: Subject to any disclaimer, the term of this patent is extended or adjusted under 35 U.S.C. 154(b) by 144 days.

(21) Appl. No.: 09/904,229

(22) Filed: Jul. 12, 2001

(65) Prior Publication Data

US 2003/0011483 A1 Jan. 16, 2003

(51) Int. Cl.[7] ..... G08B 21/00

(52) U.S. Cl. ..... 340/677; 340/552; 340/657; 340/561; 73/158; 324/513

(58) Field of Search ..... 340/664, 665, 340/668, 686.6, 673, 675, 677, 679, 657, 561, 552; 73/158, 835; 187/393, 394, 791; 324/512, 513

(56) References Cited

U.S. PATENT DOCUMENTS

| | | | | | |
|---|---|---|---|---|---|
| 4,145,920 | A | * | 3/1979 | Yamagami | 73/158 |
| 4,803,888 | A | | 2/1989 | Choquet | |
| 5,195,393 | A | | 3/1993 | Wolfington et al. | |
| 5,566,786 | A | | 10/1996 | De Angelis et al. | |
| 5,834,942 | A | | 11/1998 | De Angelis | |
| 6,073,728 | A | * | 6/2000 | Olson et al. | 187/414 |
| 6,123,176 | A | * | 9/2000 | O'Donnell et al. | 187/393 |
| 6,289,742 | B1 | * | 9/2001 | De Angelis | 73/835 |

FOREIGN PATENT DOCUMENTS

| | | |
|---|---|---|
| EP | 0 731 209 | 9/1996 |
| EP | 1 029 973 | 8/2000 |
| JP | 04361981 | 12/1992 |
| WO | WO 00/37738 | 6/2000 |

OTHER PUBLICATIONS

Wehking, K.H., "Magnetic inductive testing of elevator ropes", Nov.–Dec., 1998, pp. 16–22, Lift Report.

* cited by examiner

*Primary Examiner*—Benjamin C. Lee
(74) *Attorney, Agent, or Firm*—MacMillan, Sobanski & Todd, LLC

(57) ABSTRACT

A wear detector for a suspension rope having a plurality of load bearing strands covered by a sheath includes a sensor at a surface of the sheath. The sensor senses a characteristic of the rope representing a predetermined amount of wear of the sheath. The sensed characteristic can be electrical contact with the strands, distance from the surface of the sheath to the strands, or change of color of the sheath surface.

12 Claims, 3 Drawing Sheets

SUSPENSION ROPE WEAR DETECTOR

BACKGROUND OF THE INVENTION

The present invention relates generally to elevator suspension ropes and, in particular, to wear detectors for polyurethane coated suspension ropes.

Steel wire ropes are well known. Steel wire ropes consist of metal strands braided or twisted together to form a rope. Steel wire suspension ropes are used as stationary and as running ropes for many different purposes. Such ropes have the advantage of being inexpensive, durable, and flame retardant. One common use for suspension ropes is in elevator applications. A conventional traction type elevator application includes a cab mounted in a car frame, a counterweight attached to the car frame via the suspension rope, and a machine driving a traction sheave that is engaged with the rope. As the machine turns the sheave, friction forces between the grooved surface of the sheave and the rope move the rope and thereby cause the car frame and counterweight to raise and lower. A control device is included to monitor and control the operation of the machine and the various mechanical components of the elevator application.

Used as either stationary or running ropes, steel ropes can support heavy loads. In the case of running ropes, this tensile loading is complemented by flexural loading that reduces their service lifetime due to the number of load ranges in which they operate. The coefficient of friction or frictional value between the metal drive pulley and the steel rope is generally so low that the frictional value must be increased by different measures. These measures can include special groove shapes or special groove linings in the drive pulley, or through an increase of the loop angle. In addition, the steel rope acts as a sound bridge between the drive and the elevator car, which entails a reduction in travelling comfort. These running steel wire ropes, moreover, do not last forever, as mechanical wear of the ropes is an obvious consequence of their continual operation. Due to increasing stresses, friction and wear, wire fractures gradually occur in the bending zones. These fractures occur due to a combination of different loads on the elevator ropes, low tension stresses, and high pressures at high cycle rates. The safety of the steel wire rope condition is monitored in order to detect an operationally critical state of their wear, in advance of failure of the ropes. This is known in the art as controllable wire rope failure, which means that the danger-free remaining period of use can be read from an outward degree of wear of the steel wire rope. Once a predetermined amount of wear has occurred, the steel wire rope is replaced. In addition, steel wire ropes require lubrication. The steel wire ropes are treated with an oil lubrication that ultimately can be deposited on the elevator car frame and equipment.

One known method of solving the friction, travelling comfort, and wear resistance problems is to construct ropes of synthetic fiber. Synthetic fiber ropes, however, are not always desirable because they are relatively expensive compared to a steel rope. Another known method of solving the friction, noise, and wear resistance problems is to provide a coating, or sheath. The sheath allows smoother and quieter elevator operation in that there is less friction when the rope moves across the pulleys and sheaves as compared to the metal-to-metal contact with a steel rope that does not have a sheath. The sheath is typically formed from a synthetic plastic material, such as polyurethane, and its purpose is to provide wear resistance for the wire rope. Another benefit is that the sheath provides a sacrificial wear material so the metallic drive pulley wear is at least reduced and at best eliminated. Once the sheath has sustained a predetermined amount of wear, like conventional steel wire ropes, the rope is replaced.

The current means of wear detection of polyurethane type covers is to visually inspect on a periodic basis for cover wear or damage. This is a time-intensive operation that requires the elevator to be placed out of service while maintenance personnel perform the visual inspection of the entire suspension rope. It is desirable to reduce both the amount of time and the manpower necessary to determine the wear or damage of the polyurethane cover of the suspension rope. It is also desirable to monitor the wear of the polyurethane sheath and to provide a notification to the operator of an elevator as soon as abnormal or increased wear on a suspension rope is detected.

It is an object of this invention, therefore, to detect, by either electrical or optical means, the wear on the rope sheath in order to determine when the rope needs replacement. It another object of this invention to provide an inexpensive means for determining wear or damage on a suspension rope and to be able to determine the amount of wear or damage remotely.

SUMMARY OF THE INVENTION

The present invention concerns an apparatus for detecting wear in suspension ropes with polyurethane sheaths when used with an elevator assembly.

In a preferred embodiment, the present invention contemplates detecting wear of the non-conductive polyurethane sheath by providing a sensing circuit with any grounded object such as a drive sheave or an idler sheave. When the electrically conductive strands of the rope make contact with the drive sheave or idler sheave through the worn non-conductive polyurethane cover, the sensing circuit signals the control device to take the car out of service once the rope becomes electrically grounded.

In an alternative embodiment, the present invention contemplates detecting wear of the non-conductive polyurethane sheath by providing a proximity sensor that contacts the polyurethane sheath and actively measures the sheath thickness as a distance to the rope strands. The sensor signals the elevator control device to take the car out of service once a predetermined cover thickness wear has occurred.

In another alternative embodiment, the present invention contemplates detecting wear of the non-conductive polyurethane sheath by providing layers of different colors. The polyurethane sheath changes color when an outer layer of one color is worn away to expose an inner layer of another color indicating that predetermined wear has occurred. An optical sensor is then utilized to detect the inner layer color and signal the control device to take the car out of service.

In each of the above-described embodiments, the present invention provides a sensor means for the active monitoring of the wear of the rope polyurethane sheath at all times. The present invention provides multiple means for remotely monitoring the rope polyurethane cover wear, with each means utilizing low cost technology components. The present invention is also able to detect both complete and partial wear of the rope polyurethane cover. In addition, the present invention allows the rope polyurethane cover wear to be visually inspected without the use of measurement tools.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENTS

Figure 1A:
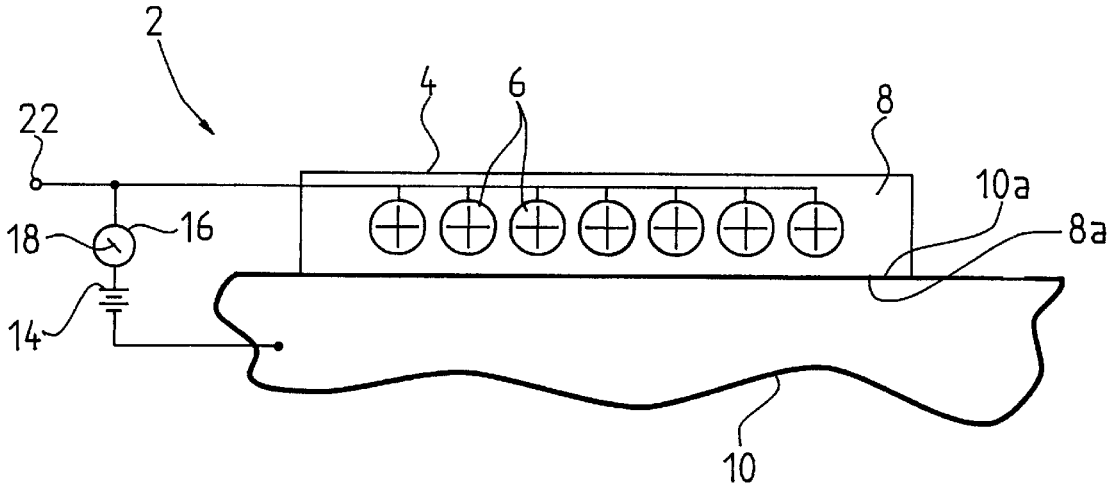
FIGS. 1*a* and 1*b* are cross-sectional views of a suspension rope wear detector in accordance with the present invention.

Referring now to FIG. 1*a*, a suspension rope wear detector is indicated generally at 2. A wire rope 4 is shown in cross section as including a plurality of load supporting wire members or strands 6 that extend longitudinally a length of the rope. The wire members 6 are preferably constructed of an electrically conductive material and typically are wound from a plurality of individual wires. An electrically insulating sheath 8 encases the members 6 of the wire rope 4. The sheath 8 is preferably constructed of a synthetic plastic material, such as polyurethane. The wire rope 4 is in contact with an electrically grounded member 10. The grounded member 10 may be a traction sheave, an idler sheave, or any other member that is formed of electrically conductive material. Although the rope 4 is depicted as being belt-like, with a planar surface 8*a* engaging a facing planar surface 10*a* of the grounded member 10, other rope and pulley forms are known such as a generally circular cross section rope engaging a grooved pulley. The rope 4 is shown in a usable condition wherein the sheath 8 electrically insulates the wire members 6 from the grounded member 10.

Figure 1B:
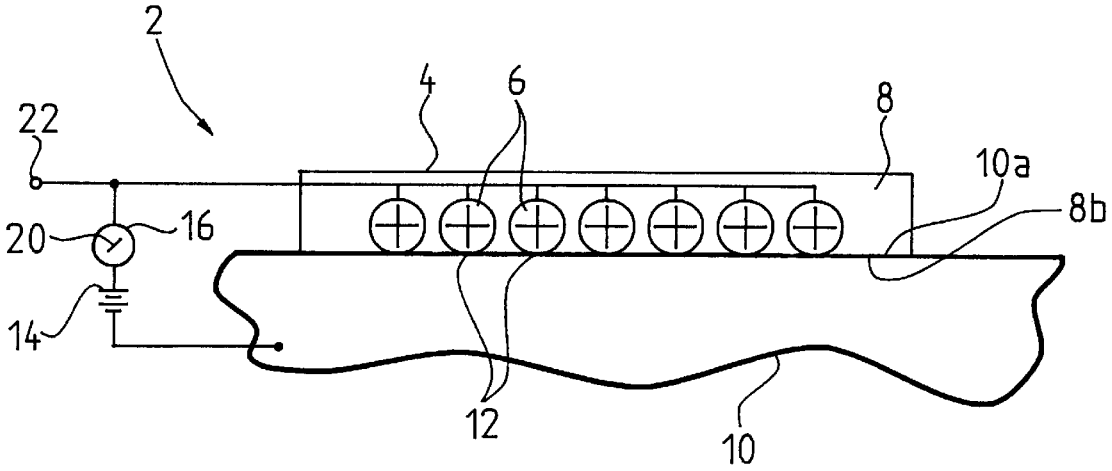

Referring now to FIG. 1*b*, the rope 4 is shown with the sheath 8 in a worn condition wherein the surface 8*a* shown in FIG. 1*a* is worn away down to an inner surface 8*b*. One or more of the wire members 6 is exposed through the surface 8*b* to contact the grounded member surface 10*a* at a contact point 12. The wire members 6 and the grounded member 10 are electrically connected at the contact points 12. The wear detector 2 includes a sensor means having a power supply 14 and an indicator 16 electrically connected in series between the wire members 6 and the grounded member 10. In FIG. 1*a*, there is an open circuit due to the insulating properties of the sheath 8 such that no current flows from the power supply 14 through the indicator 16 which provides a first display 18 indicating that the rope 4 can remain in service. In FIG. 1*b*, there is a closed circuit at contact points 12 due to the wear of the sheath 8 permitting current flow through the indicator 16 which provides a second display 20 indicating that the rope 4 should be removed from service. A signal terminal 22 of the sensor means can be connected to an elevator control device (not shown) to generate an output signal in response to which the control device then takes the appropriate action with respect to the indicated condition, including ceasing elevator operation when the output signal represents the second display 20 wear indication.

Figure 2A:
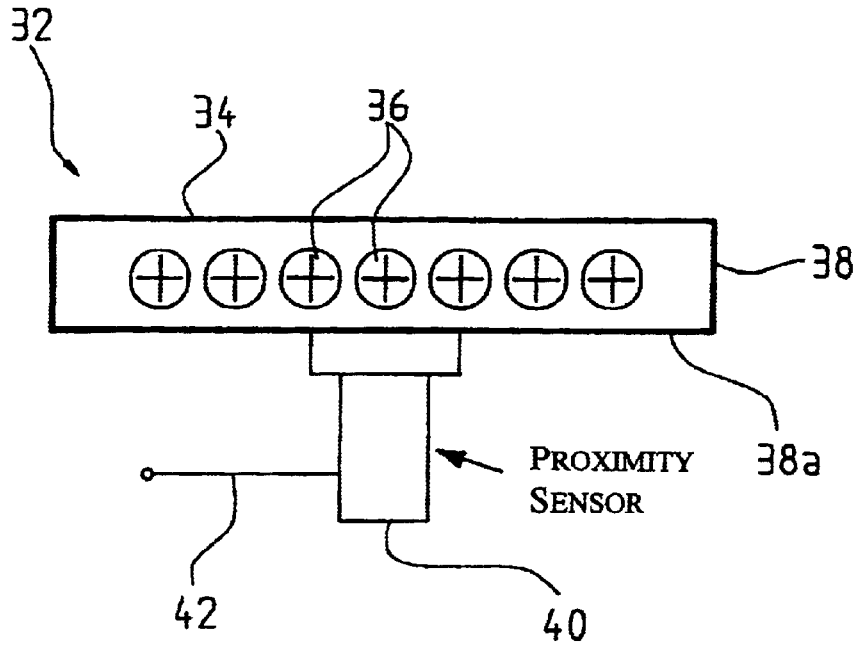
FIGS. 2*a* and 2*b* are cross-sectional views of a first alternative embodiment of a suspension rope wear detector in accordance with the present invention.

Referring now to FIG. 2*a*, an alternate embodiment suspension rope wear detector is indicated generally at 32. A wire rope 34 is shown that contains a plurality of wire members or strands 36. The wire members 36 are preferably constructed of a metal material. A sheath 38 encases the members 36 of the wire rope 34. The sheath 38 is preferably constructed of a synthetic plastic material, such as polyurethane. A sensor means is provided in the form of a proximity sensor 40. A surface 38*a* of the wire rope 34 abuts the proximity sensor 40 that measures the thickness of the sheath 38 as a distance between the sensor and the members 36. The proximity sensor 40 generates an output signal at a signal output 42 that can be connected to an elevator control device (not shown.) in response to which the control device then takes the appropriate action with respect to the indicated condition.

Figure 2B:
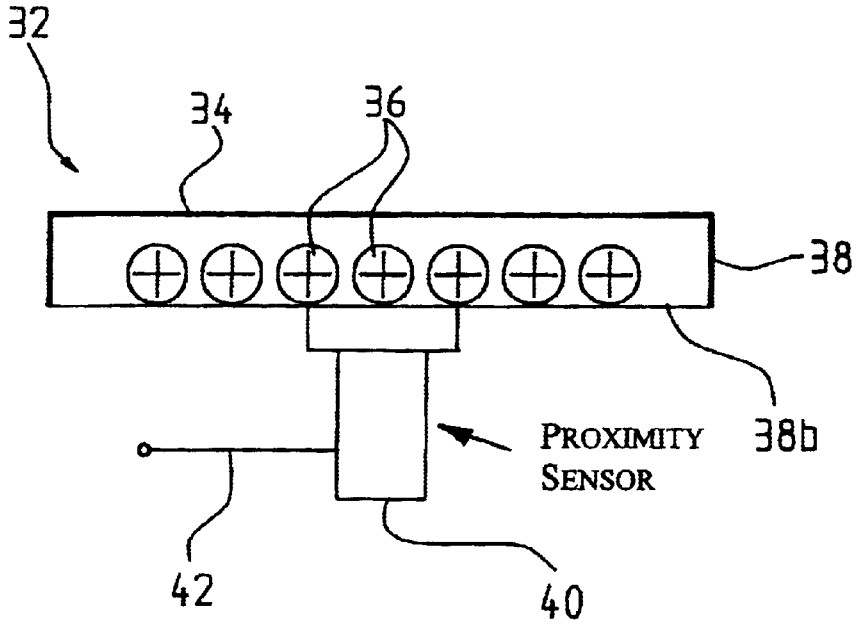

Referring now to FIG. 2*b*, the wire rope 34 is shown with the sheath 38 in a worn condition wherein the surface 38*a* shown in FIG. 2*a* is worn away down to a new surface 38*b*. Now the wire members 36 are closer to the proximity sensor 40 which generates a wear indication output signal to the control device once a predetermined amount of wear on sheath 38 has occurred. The control device then takes the appropriate action with respect to the indicated condition, most likely to cease elevator operation.

Figure 3A:
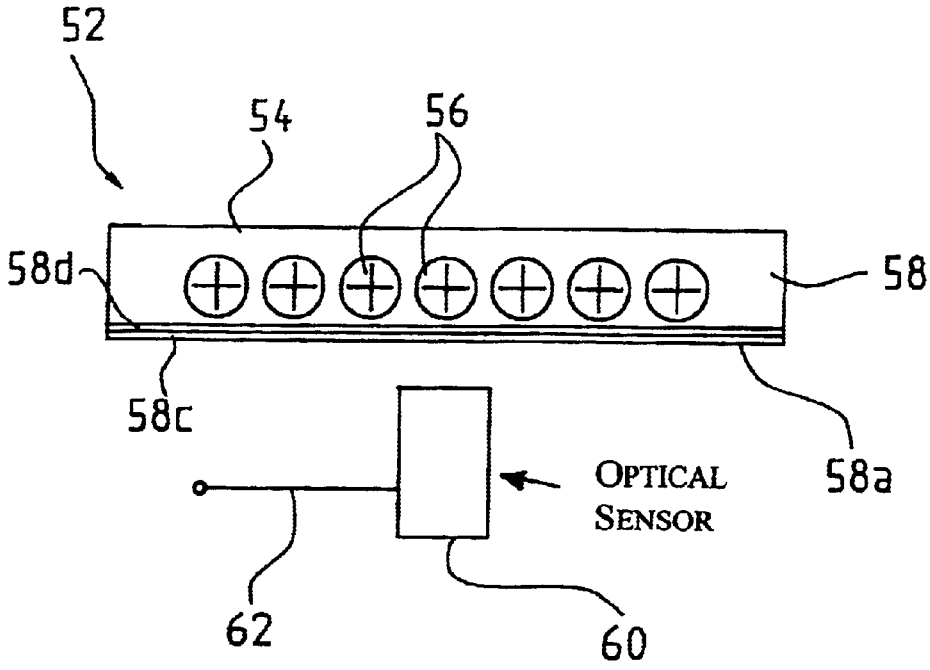
FIGS. 3*a* and 3*b* are cross-sectional views of a second alternative embodiment of a suspension rope wear detector in accordance with the present invention.

Referring now to FIG. 3*a*, a suspension rope wear detector is indicated generally at 52. A suspension rope 54 is shown that contains a plurality of members or strands 56 that can be formed of an electrically conducting material or a synthetic material. The members 56 are preferably constructed of an electrically conductive material. A sheath 58 encases the members 56 of the rope 54. The sheath 58 is preferably constructed of a synthetic plastic material, such as polyurethane, and has a plurality of colored layers, each of which corresponds to an amount of wear on the sheath. For example, a surface 58*a* displays a first color of an outer layer 58*c* and a surface 58*b* displays a second color of an inner layer 58*d*. Although the layers 58*c* and 58*d* are shown as extending in a single plane, they could extend any distance about the periphery of the rope 54 including completely around it.

The surface 58*a* of the rope 54 passes by an optical sensor 60, which detects the contrasting first color of the sheath 58 that represents a first amount of acceptable wear of the sheath 58. The optical sensor 60 has a signal output 62 for connection to an elevator control device (not shown.). Thus, a first output signal generated at the output 62 indicates to the control device that the rope 54 can remain in service.

Figure 3B:
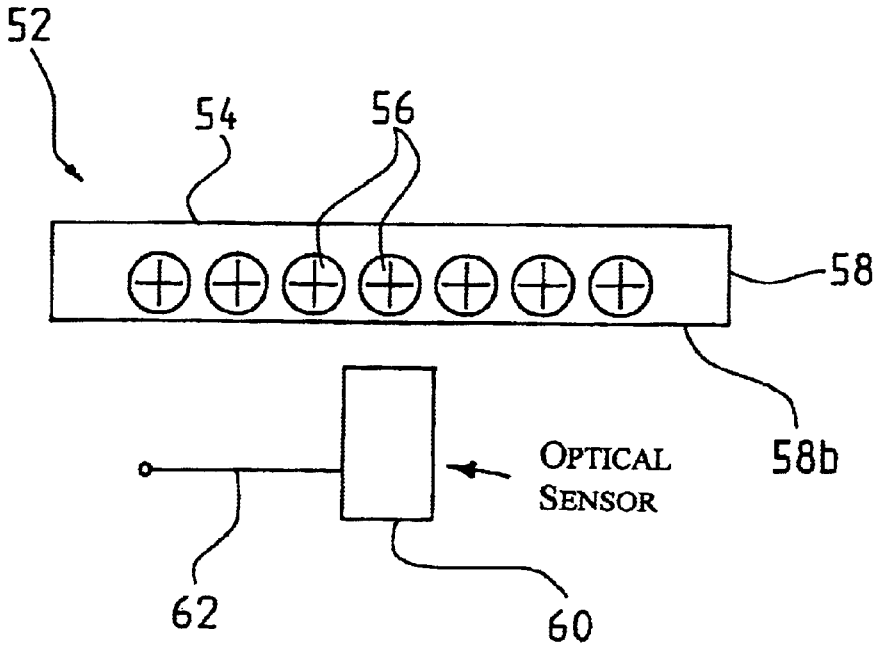

Referring now to FIG. 3*b*, the wire rope 54 is shown with the sheath 58 in a worn condition whereby the surface 58*b* is exposed. The optical sensor 60 senses the change from the first color of the surface 58*a* to the second color of the surface 58*b* and generates a second signal, wear indication output signal, at the output 62 indicating that a predetermined amount of wear has taken place whereby the rope 54 should be taken out of service. The elevator control device then can take the appropriate action, most likely to cease elevator operation.

In summary, the suspension ropes 4, 34 and 54 are formed from at least one load bearing strand covered by sheath. A sensor means is provided for monitoring a surface of the sheath and generating a wear indication output signal representing at least one predetermined wear condition of the rope and includes an output adapted to be connected to an elevator control device for transmitting the wear indication output signal. With respect to the rope 4, a sensor means 14, 16 provides an electrical circuit whereby contact between the electrically conducting strands 6 and an electrically conducting member 10 generates the wear indication output signal. With respect to the rope 34, a proximity sensor means 40 senses a distance between the strands 36 and a surface of the sheath 38 to generate the wear indication output signal. With respect to the rope 54, an optical sensor means 60 senses a color change in a surface of the sheath 58 to generate the wear indication output signal. As described with respect to the cable 4, the cables 34 and 54 can be formed in any suitable configuration such as a generally circular cross section rope wherein the strands are twisted about a central core strand.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator suspension rope comprising:

a plurality of load bearing strands extending longitudinally to form a suspension rope;

a sheath coving said strands and having an outer surface; and a sensor means for sensing wear of said sheath and generating a wear indication output signal upon sensing a characteristic of the rape representing a predetermined wear condition related to thickness of said sheath adjacent said sensor means, said sensor means being external to said sheath and adjacent said outer surface of said sheath.

2. The suspension rope according to claim 1 wherein said strands and said sheath form a belt-like rope and said outer surface is a relatively flat surface.

3. The suspension rope according to claim 1 wherein said sensor means is one of a electrically conducive member, a proximity sensor and an optical sensor.

4. An elevator suspension rope comprising:

a plurality of load bearing strands extending longitudinally to form a suspension rope, said strands being formed of a first material;

a sheath coving said strands, said sheath being formed of a second material and having an outer surface; and a sensor means for sensing wear of said sheath and generating a wear indication output signal upon sensing a characteristic of the rope representing a predetermined wear condition related to thickness of said sheath, said sensor means being external to said sheath and adjacent said outer surface of said sheath for sensing said characteristic as one of electrical contact of at least one of said strands with a surface of said sensor means, a predetermined distance between at least one of said strands and said sensor means, and a change in color of said sheath.

5. The suspension rope according to claim 4 wherein said sensor means includes an electrically conductive member abutting said outer surface of said sheath and a power supply connected between said strands and said member, said wear indication output signal being current flow between at least one of said strands and said conductive member when said sheath is worn away to expose said at least one stand and permit contact between said at least one strand and said member.

6. The suspension rope according to claim 5 wherein said sensor means includes an indicator connected to said power supply for proving a visual display representing said predetermined amount of wear.

7. The suspension rope according to claim 5 wherein said member is a sheave engaging said outer surface of said sheath.

8. The suspension rape according to claim 4 wherein said sensor means includes a proximity sensor contacting said outer surface of said sheath, said wear indication output signal being generated by said proximity sensor when said sheath is worn away to move at least one of said stands within a predetermined distance of said proximity sensor.

9. The suspension rape according to claim 4 wherein said sensor means includes an optical sensor positioned adjacent said outer surface, the sheath having an outer layer of one color and at least one inner layer of a second color, said wear indication output signal being generated by said optical sensor when said sheath is worn away to expose said at least one inner layer.

10. The suspension rope according to claim 4 wherein said strands and said sheath form a belt-like rope and said outer surface is a relatively flat surface.

11. A wear detector for an elevator suspension rope, the rope being formed from at least one load bearing strand covered by a sheath, comprising:

a sensor means for monitoring a surface of the sheath and generating a wear indication output signal representing at least one predetermined wear condition of the rope related to a thickness of the sheath adjacent said sensor means, said sensor means including an optical sensor positioned adjacent the surface, the sheath having an outer layer of one color including the surface and at least one inner layer of a second color, said wear indication output signal being generated by said optical sensor when the outer layer of the sheath is worn away to expose the at least one inner layer; and an output connected to said sensor means and adapted to be connected to an elevator control device for transmitting said wear indication output signal.

12. An elevator suspension rope comprising:

a plurality of load bearing strands extending longitudinally to form a suspension rope;

a sheath coving said strands; and a sensor means for sensing a wear condition related to thickness of said sheath at a surface of said sheath adjacent said sensor means and generating a wear indication output signal upon sensing a predetermined amount of wear of said sheath, said sensor means including an optical sensor positioned adjacent said surface, the sheath having an outer layer of one color including said surface and at least one inner layer of a second color, said wear indication output signal being generated by said optical sensor when said outer layer of the sheath is worn away to expose said at least one inner layer.

* * * * *